US005109212A

United States Patent [19]

Cortinovis et al.

[11] Patent Number: 5,109,212

[45] Date of Patent: Apr. 28, 1992

[54] ELECTRONICALLY CONTROLLED HORN FOR MOTOR VEHICLES

[76] Inventors: Bruno Cortinovis, Via Piccinelli, 6, 24100 Bergamo; Tullio Giorgioni, Via Donizetti, 4, 24020 Selvino (Bergamo), both of Italy

[21] Appl. No.: 493,285

[22] Filed: Mar. 14, 1990

[30] Foreign Application Priority Data

Mar. 29, 1989 [IT] Italy ..... 19935 A/89

[51] Int. Cl.[5] ..... H04R 3/00; G08B 3/00

[52] U.S. Cl. ..... 340/384 E; 340/388; 381/96

[58] Field of Search ..... 381/192, 96, 123, 110, 381/59; 340/384 E, 388

[56] References Cited

U.S. PATENT DOCUMENTS

| | | | |
|---|---|---|---|
| 4,241,334 | 12/1980 | Shintaku | 340/388 |
| 4,691,361 | 9/1987 | Yoshino et al. | 381/123 |
| 4,727,584 | 2/1988 | Hall | 381/96 |

FOREIGN PATENT DOCUMENTS

| | | | |
|---|---|---|---|
| 0266485 | 5/1988 | European Pat. Off. | 340/384 E |
| 3524280 | 1/1987 | Fed. Rep. of Germany | 381/96 |
| 0242696 | 2/1987 | Fed. Rep. of Germany | 381/192 |

*Primary Examiner*—Forester W. Isen
*Assistant Examiner*—Jason Chan
*Attorney, Agent, or Firm*—Steinberg & Raskin

[57] ABSTRACT

A horn comprising a diaphragm, an electromagnet, a transducer to sense the vibrations of the diaphragm and generate a vibration-dependent electrical signal, and a feedback circuit which controls a power supply to the electromagnet. The feedback circuit includes an electronic power circuit (E, IEP) controlled by a control circuit (μ, F, CCS) arranged to adapt, condition and process the electrical signal from the transducer (S) in such a manner as to automatically determine the frequency and duty cycle for controlling the electronic power circuit (IEP) under the various environmental, electrical feed and constructional tolerance conditions of the horn.

10 Claims, 1 Drawing Sheet

ELECTRONICALLY CONTROLLED HORN FOR MOTOR VEHICLES

BACKGROUND OF THE INVENTION

1. Field of the Invention

This invention relates to electromechanical devices for sound generation, and particularly to high-sounding horns for use in motor vehicles.

2. Description of Related Art

Sound generating devices of the electromagnetic excitation type currently consist of:

- a resilient steel diaphragm carrying in its centre the mobile part (armature) of an electromagnet;
- an electric switch with a normally closed contact connected in series with the power feed to the electromagnet;
- an adjustment screw which determines the switch contact opening and
- a diffuser which resonates at the same frequency as the metal diaphragm.

When the electromagnet is electrically powered, it attracts the armature rigid with the resilient diaphragm. When the diaphragm has nearly attained its maximum travel, the switch connected in series with the electromagnet coil is opened by a push rod operated by the mobile assembly of the electromagnet. At this point the elastic energy accumulated by the diaphragm is restituted by reaction with the fixed structure to which it is connected, so that the diaphragm reverses its direction of movement. In this manner it again closes the switch which, again exciting the electromagnet, causes the diaphragm to commence a new oscillation cycle at a frequency equal to the resonance frequency of the electromechanical system.

These normal switch devices have considerable drawbacks, which can be summarized as follows:

- As the sound output of the horn depends on the time at which the switch operates, it is difficult to obtain maximum sound output because of the difficulty of fixing or adjusting the switch operation point.
- The sound output is subject to considerable fall-off with time due to the mechanical instability of the switch operation points.
- The switch contacts are subject to sparking which causes them to wear and lead to a variation in their time of operation, with reduction in sound output.
- The contact sparking creates electromagnetic waves which can be troublesome to the electronic systems increasingly used in modern motor vehicles.

To obviate these drawbacks, different methods have been conceived for controlling the excitation of the electromagnet coupled to the resilient steel diaphragm, these still being essential elements for the low-cost generation of high-intensity sound at frequencies less than one kilohertz.

The first alternative to the switch uses electronic oscillators operating at a vibration frequency approximately equal to the resonance frequency of the electromagnetic system; with this method the oscillator output controls an electronic switch connected in series with the coil, thus replacing the mechanically operated switch.

However, this method has certain drawbacks which can be summarized as follows:

- the need for an oscillator the frequency of which is stable with varying feed voltage and having a frequency-temperature characteristic curve equal to that of the mechanical unit; and
- in order to limit to a minimum any differences between the oscillator frequency and the diaphragm resonance frequency, the diaphragm production tolerances must be restricted or alternatively a selection and coupling procedure must be implemented.

All this results in high production costs which are difficult to accept by the user.

The aforesaid drawbacks can be obviated by linking the electronic oscillator frequency to the resonance frequency of the resonance frequency of the electromechanical unit which generates the sound. Such a method has already been proposed in French patent 1,428,483, which is now in public domain.

FIG. 1 shows the schematic diagram of said patent. In this figure a transducer S sensitive to diaphragm vibration is coupled to the diaphragm M of a horn X. The transducer S can be a known sensor sensitive to the vibration of the resilient diaphragm M of the horn, to generate at its output a voltage signal having a frequency corresponding to the vibration frequency. The transducer S feeds its signal to the input of an amplifier $\mu$ via a positive feedback circuit $\phi$, it being thus suitably amplified and then fed to the electromagnet E. The resultant vibration of the diaphragm M results in the reproduction of a voltage signal in the sensor S greater than that which it had generated but of coincident phase and frequency. The required oscillator with a resonance frequency the same as that of the electromagnetic sound generation system is therefore obtained.

A horn using an electronic circuit based on the above principle has better characteristics than a horn incorporating a mechanical switch or a fixed frequency electronic circuit, however the characteristics are insufficient for a high-sounding horn. To improve the sound output in relation to the current absorbed by the electromagnet in horns with a mechanical switch or fixed frequency electronic circuit it is already known to use an arrangement which exploits to a maximum the greater force of attraction which the electromagnet exerts on the armature when the air gap is reduced to the allowable minimum.

This arrangement consists of prolonging the electrical feed to the electromagnet beyond 50% of the inherent frequency period of the electromechanical system. The mean optimum value of the feed:response ratio is 65%:35%. It therefore follows that by applying this electromagnet feed concept the diaphragm oscillation is no longer sinusoidal. A sized spacer can be provided for each horn positioned along the diaphragm support perimeter on the side facing the electromagnet, to raise the voltage at which mechanical contact is obtained between the armature rigid with the diaphragm and the electromagnet to beyond the maximum voltage which can be provided by the battery.

This makes the arrangement inapplicable to the circuit configuration of FIG. 1.

SUMMARY OF THE INVENTION

The main object of the present invention is to make the principle of the electronic circuit for exciting the electromagnet at the inherent resonance frequency of the electromechanical sound generating component, this being a characteristic of the circuit of FIG. 1, compatible with the concept of asymmetric cycle feed to the electromagnet.

A further object of the present invention is to automatically control the asymmetric cycle in such a manner as to compensate for the constructional differences between one horn and another and to improve its operation as the output voltage of the vehicle battery varies.

These and further objects which will be more apparent from the detailed description given hereinafter are attained by a horn comprising a diaphragm and electromagnet, of the type comprising a transducer to sense the vibrations of the diaphragm and feed a vibration-dependent electrical signal to a feedback circuit which controls the power supply to the electromagnet, said horn being characterized essentially in that the feedback circuit comprises an electronic power circuit controlled by means arranged to adapt, condition and process the electrical signal from the transducer in such a manner as to automatically determine and generate both the frequency and duty cycle for controlling the electronic power circuit under the various environmental, electrical feed and constructional tolerance conditions of the horn.

The present invention will be more apparent from the description of some non-limiting embodiments thereof shown on the accompanying drawings.

DETAILED DESCRIPTION OF THE PREFERRED EMBODIMENTS

Figure 1:
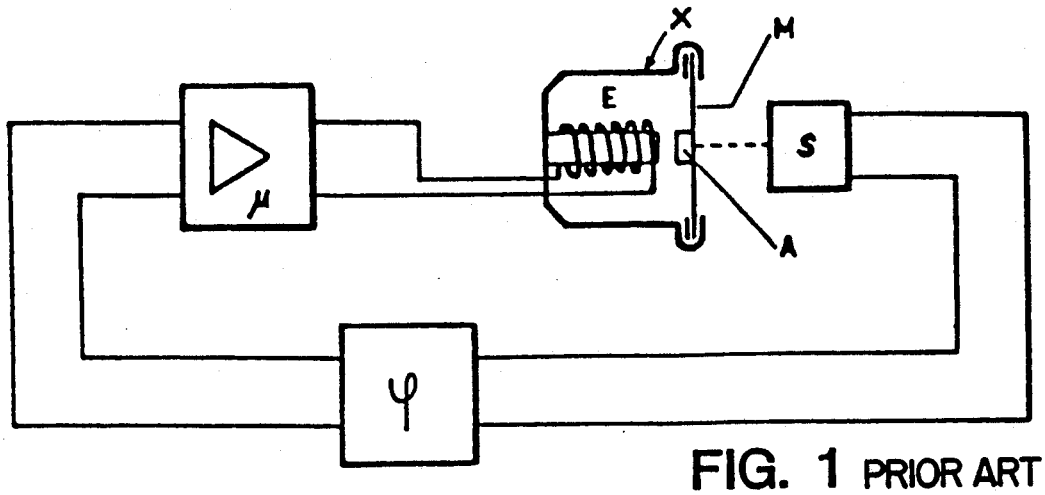
FIG. 1 PRIOR ART
FIG. 1 is a schematic diagram of an electronically controlled horn according to the Prior Art.
Figure 2:
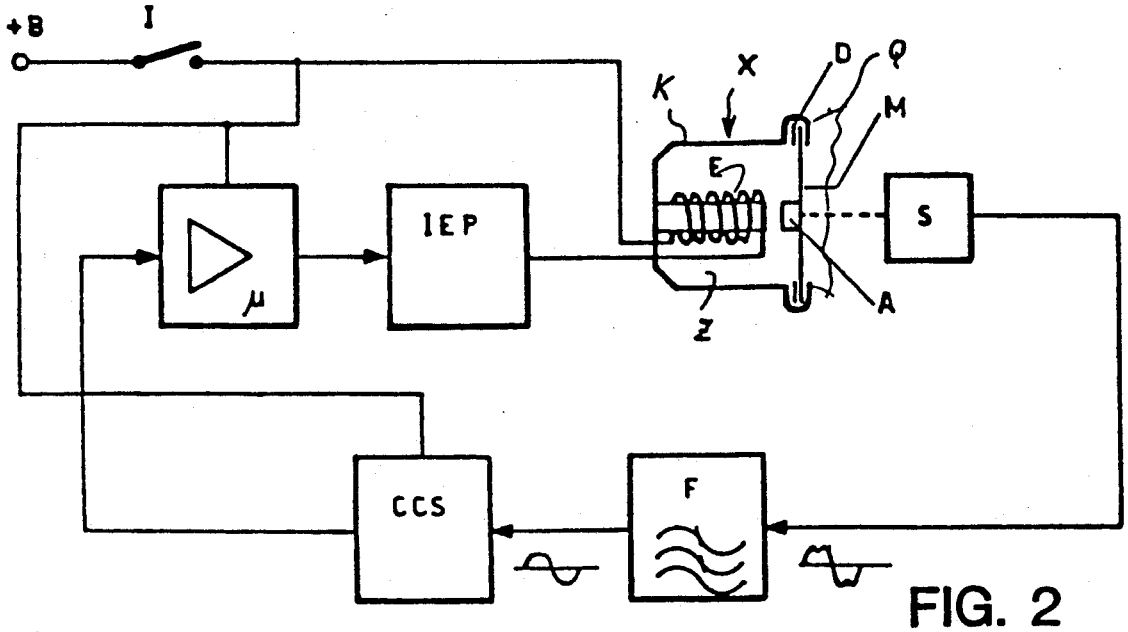
FIG. 2 is a schematic diagram showing the principle on which the invention is based.

With reference to FIG. 2, X indicates the actual horn. It comprises a casing K to which a metal diaphram M is peripherally clamped by a spacer ring D, this being advantageously non-sized so as to result in greater constructional economy. In the chamber Z defined by the casing K and diaphragm M there is an electromagnet E, the armature A of which is rigid with the diaphragm M. Q indicates a resonant diffuser associated with the horn. A sensor or transducer S is operationally engaged with the armature A. It generates a voltage signal proportional to the oscillation of the diaphragm M. The term "operationally engaged" signifies that the transducer S can be either connected mechanically to the diaphragm or physically separate from it. An example of a physically separate transducer is a piezoelectric transducer connected by a spring or piston to the centre of the diaphragm to sense its oscillation.

The voltage signal leaving the transducer S proportional to the oscillation of the diaphragm M reaches a low pass filter F which filters the voltage signal to eliminate harmonics generated in the transducer by the non-harmonic movement of the diaphragm M. At the output of the filter F there is therefore a sinusoidal voltage signal of frequency equal to the frequency of the fundamental vibration of the diaphragm M and of amplitude proportional to said vibration.

This output signal is fed to a signal conditioning circuit (CCS). From the output voltage signal of the filter F the circuit CCS obtains two logic signals, the first of duration equal to the half period of the oscillating frequency of the diaphragm M and the second of duration inversely proportional to the amplitude of said signal, and then recombines these signals to provide at its output a logic signal of duration equal to the sum of the times of the two signals analogously with pulse-width modulation. Various circuit configurations can be proposed for effecting the function assigned to the circuit CCS.

Assuming that, for correct compensation of the phase lag introduced by the low pass filter F, the commencement of excitation of the coil of the electromagnet E corresponds to the commencement of the negative half period of the sinusoidal signal present at the input of the circuit CCS, a single comparator will produce a logic signal 1 foar the entire negative half period of the signal.

A second comparator, preset with a positive switching level equal to about 60% of the peak value of the positive half wave of the signal, will produce a logic signal 1 for the period between the commencement of the positive half wave and the attainment of the preset switching value.

If the outputs of the two comparators are connected together in OR configuration the result will be a logic signal 1 the duration of which is characteristic of the frequency and amplitude of the signal from the sensor S. This logic signal is fed to a current amplifier $\mu$ which interfaces the output of the circuit CCS with the input of a solid state power switch IEP which provides the current required for controlling the electromagnet E.

Other circuit techniques can be used to provide the function required of the circuit CCS. Amplitude limitation of the input signal can be employed using circuits which obtain the logic signal inversely proportional to the signal amplitude by differentiating the signal itself instead of by circuits using fixed thresholds. This can for example be at the discretion of the company constructing the custom circuit, the company then using for obtaining the function required of the circuit CCS those circuit configurations which best match the chosen integration technology.

To better understand the overall operation of the circuit, it will be assumed that a current flows through the electromagnet E of intensity equal to the mean value of the battery voltage B for a time of 65% of the period corresponding to the resonance frequency of the electromechanical sound generation system E, A, M, D, to produce a sound output equal to the average output of the device. The transducer S generates a signal of mean amplitude proportional to the movement of the diaphragm M and of frequency equal to the resonance frequency of the system E, A, M, D. The low pass filter F eliminates the harmonics present in the signal and feeds to the circuit CCS a sinusoidal signal of mean amplitude and frequency equal to the resonance of the system E. A. M, D. The circuit CCS conditions the signal present at its input such as to generate at its output a signal of 65% duty cycle, phase and frequency of the current circulating through the electromagnet E which has generated it.

The amplifier circuit $\mu$ provides the signal required for the electronic power switch (such as a Darlington transistor) IEP to feed to the electromagnet E a current of the given value for a mean battery voltage for the time predetermined by the circuit CCS.

It is therefore apparent that when factors occur such as a fall in the battery voltage, an increase in the air gap due to constructional dimension tolerances, or any condition resulting in a reduction in the sound output of the sound generating device, a circuit with the aforesaid functions will make an automatic correction by increasing the duty cycle by up to about 75%. This correction takes place because if the sound signal falls below the mean value a proportional reduction occurs in the signal generated by the sensor S.

Consequently the circuit CCS makes a proportional increase in the duty cycle, thus producing an increase in the mean current through the electromagnet E with a consequent increase in the sound output of the horn.

In the same manner, if factors which increase the sound output occur such as an increase in the battery voltage or a reduction in the air gap, the circuit CCS makes a proportional reduction in the duty cycle by up to about 50%.

Thus a circuit composed in this manner will automatically correct the duty cycle and frequency so as to compensate for any constructional tolerances of the components concerned in the sound generation, to obtain an optimum sound level under all feed voltage and environmental conditions.

Figure 3:
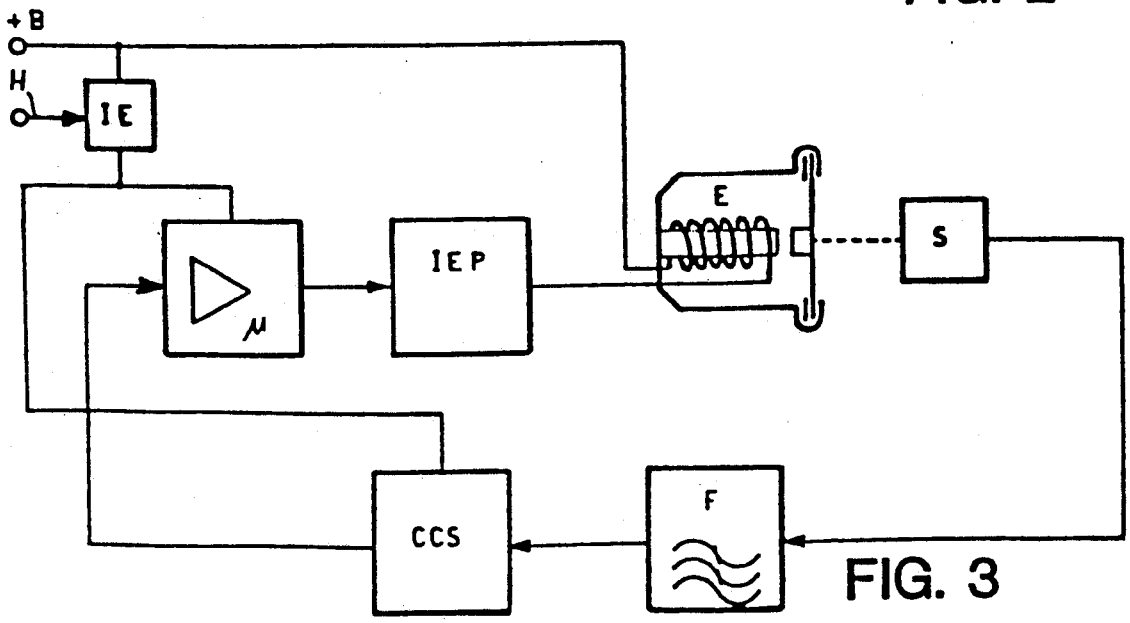
FIG. 3 is a modification of the embodiment of FIG. 2.

The circuit of FIG. 3 represents a modification to the circuit configuration of FIG. 2. A characteristic of this circuit is the different command for activating the horn. In this respect the power circuits are permanently connected to the feed battery whereas the active circuits CCS and $\mu$ are activated by an electronic switch IE which receives a low power logic command originating (line H) from a horn operating pushbutton or another electronic circuit.

For the purposes of economical mass production it is advisable to choose a piezoelectric transducer S having the additional characteristic of a piezoelectric sound generator (buzzer) which, mass produced for commercial applications, is of low cost and of high reliability within the working temperature range.

For the electronic circuit, the solution to adopt is to use the technology currently available from semiconductor integrated circuit manufacturers, which combine both logic and digital functions on a single chip. In particular the best solution is to use a single custom device employing a technique which enables a single chip to provide not only the logic and analog functions required by the blocks F, CCS and $\mu$ blocks but also the power device for providing the function required of the block IEP. The complete custom device therefore assumes the appearance of a power transistor the heat dissipation element of which, isolated from the electronic circuit, can be advantageously fixed to the metal housing of the horn without the need for insulation.

The advantages offered by a custom circuit arrangement can be summarized as follows:

A small number of components making up the horn control unit (custom electronic circuit, sensor, armature connecting the sensor to the diaphragm).

A low custom circuit cost for the high quantities foreseeable for the motor vehicle market.

Possible simplification and automation of the horn assembly.

We claim:

1. An electromechanical horn comprising:

(a) a horn having electrically-powered vibration means for generating vibrations at a vibration frequency and a vibration amplitude;

(b) power supply means for supplying electrical power to the vibration means during a duty cycle;

(c) transducer means for sensing the vibrations to generate an electrical transducer signal having a transducer frequency and a transducer amplitude respectively representative of the vibration frequency and the vibration amplitude; and (d) control means responsive to the transducer signal for automatically varying the duty cycle to compensate for variations in the sound level of the horn.

2. The arrangement according to claim 1, wherein the control means includes means for processing the transducer signal to generate an electrical control signal having a time duration proportional to the transducer frequency and inversely proportional to the transducer amplitude, and means for controlling the power supply means with the control signal to supply electrical power to the vibration means during said time duration of the control signal, thereby varying the duty cycle and compensating for sound level variations.

3. The arrangement according to claim 2, wherein the processing means includes means for removing harmonic frequencies from the transducer signal.

4. The arrangement according to claim 3, wherein the removing means is a low pass filter.

5. The arrangement according to claim 2, wherein the controlling means includes an amplifier for amplifying the electrical power supplied to the vibration means.

6. The arrangement according to claim 1, wherein the vibration means includes a casing, an electromagnet in the casing and having an armature, and a diaphragm mounted on the casing for vibrating movement, said armature being mounted on the diaphragm for joint movement therewith.

7. The arrangement according to claim 6, wherein the power supply means includes a battery for supplying electrical current to the electromagnet, and a power switch through which the electrical current is conducted from the battery to the electromagnet.

8. The arrangement according to claim 7, wherein the power switch is a solid-state component.

9. The arrangement according to claim 8, wherein the power switch and the control means constitute a single electronic device.

10. The arrangement according to claim 7, wherein the power supply means includes a control switch operatively connected between the battery and the power switch, said control switch having a low power control input.

* * * * *